US007291054B2

(12) United States Patent
Choi

(10) Patent No.: US 7,291,054 B2
(45) Date of Patent: Nov. 6, 2007

(54) TOY WITH PROGRAMMABLE REMOTE CONTROL

(75) Inventor: Kevin Choi, Hong Kong (CN)

(73) Assignee: Silverlit Toys Manufactory, Ltd., Hong Kong (HK)

( * ) Notice: Subject to any disclaimer, the term of this patent is extended or adjusted under 35 U.S.C. 154(b) by 578 days.

(21) Appl. No.: 10/279,534

(22) Filed: Oct. 23, 2002

(65) Prior Publication Data

US 2004/0082268 A1 Apr. 29, 2004

(51) Int. Cl.
*A63H 30/00* (2006.01)

(52) U.S. Cl. ..... 446/454

(58) Field of Classification Search ..... 446/454, 446/436

See application file for complete search history.

(56) References Cited

U.S. PATENT DOCUMENTS 6,083,104 A * 7/2000 Choi ..... 463/6
6,250,987 B1 * 6/2001 Choi ..... 446/436
6,390,883 B1 * 5/2002 Choi ..... 446/436
6,439,956 B1 * 8/2002 Ho ..... 446/454
6,529,139 B1 * 3/2003 Behun et al. ..... 446/456
6,546,436 B1 * 4/2003 Fainmesser et al. ..... 710/5
6,652,351 B1 * 11/2003 Rehkemper et al. ..... 446/354
6,663,393 B1 * 12/2003 Ghaly ..... 434/262
6,705,873 B2 * 3/2004 Higashida ..... 434/393
2003/0060287 A1 * 3/2003 Nishiyama ..... 463/45

* cited by examiner

*Primary Examiner*—Robert E. Pezzuto
*Assistant Examiner*—Alex F. R. P. Rada, II
(74) *Attorney, Agent, or Firm*—Greenberg Traurig, LLP

(57) ABSTRACT

A programmable device such as a toy or novelty item and a remote controller has a keyboard which can be activated by a user to set up any one of multiple different motions of the toy. Sounds and lights can be activated to coordinate with the movement. The toy can be a car or other device capable of moving in the environment. The toy is also controllable solely by remote control through a transmitter in the remote controller and a receiver in the toy.

35 Claims, 19 Drawing Sheets

TOY WITH PROGRAMMABLE REMOTE CONTROL

BACKGROUND OF THE INVENTION

This invention relates to a programmable system for enabling an object, preferably a toy or novelty item, to perform a series of actions chosen by a user under the action of remote control.

Many toys or novelty items are available in the market which can perform different actions instructed by a player through the use of a remote control device. Typically the use of the remote control device results in a specific action of a toy object, for instance a vehicle. The remote control systems are either infrared, or radio controlled and can only be used to instruct the vehicle to perform individual or separate actions. These kind items are limited in the variability of their performance.

Having a toy or novelty item with a variable programmable remote control would have distinct advantages and benefits in the consumer market.

The invention is directed to overcoming the limitations of existing toys and novelty items.

SUMMARY OF THE INVENTION

The invention provides for an interactive remote control programming system for a toy or novelty item. A user, by pressing appropriate keypad buttons on a remote controller can program or instruct an object to perform a series of preset actions. These actions are preset in that different keys on the remote controller are programmed to operate or effect different actions on the toy or novelty item. This can preferably be accompanied by selected sound effects and light reactions on at least one of the toy or the remote controller.

Where the remote controller is the sole manner of programming and operating the toy, and wherein in the toy cannot be independently programmed and operated there are useful advantages. The keys of the keypad are preprogrammed such that keys represent different motion events to be encoded and transmitted to the receiver.

According to the invention the programmable toy includes a body which has at least one motor for actuating a motion generator which can be in the form of wheels or other devices to cause the body to move through the surrounding environment.

There is a keypad on a remote controller for operation by the user of the toy which operates to encode a signal in the remote controller unit. This signal, which is an encoded programming signal, is transmitted to a receiver in the toy where there is a decoder in a toy unit. Activating the remote control keyboard causes the encoder in the remote controller to program a selected action, and this in turn is transmitted through an antenna to a receiver in the toy unit.

The receiver passes the signal to a decoder to operate at least one of the motors on subsequently receiving a signal from the remote control unit. The decoder in the toy is connected to, or part of, a microprocessor which translates the received remote control signals into control signals for operating at least one of the motors. The motors can thereby be caused to activate the body in different selected directions according to the action of the motors on the motive generator.

In a preferred form of the invention there is a microprocessor in at least one of, the remote controller or the toy, and this is preferably the remote controller, which include a memory function with which predetermined instructions for action and sound effects can be stored. The activities and objects to perform the action and sound effects are determined as selected by the user by programming the remote controller.

The programming system is driven by an integrated circuit chip which is responsive to the different keys on the remote controller to effect encoding and transmission of the encoded signals, and an integrated chip in the receiver effects receiving, decoding of the signals and the driving of the motors.

The transmitter sends programming signals to the toy while programming is keyed into the keyboard and the receiver system stores such programming instructions for later use by the toy unit. By having all the programming instructions inputted into the remote controller as opposed to the toy there is created a toy essentially programmable by the remote controller such that the combination of the two physically separate components, namely the toy and the remoter controller, making up the system provides for enhanced operation over previously existing systems The invention is further described with reference to the accompanying drawings.

DETAILED DESCRIPTION OF THE PREFERRED EMBODIMENT

Figure 1:
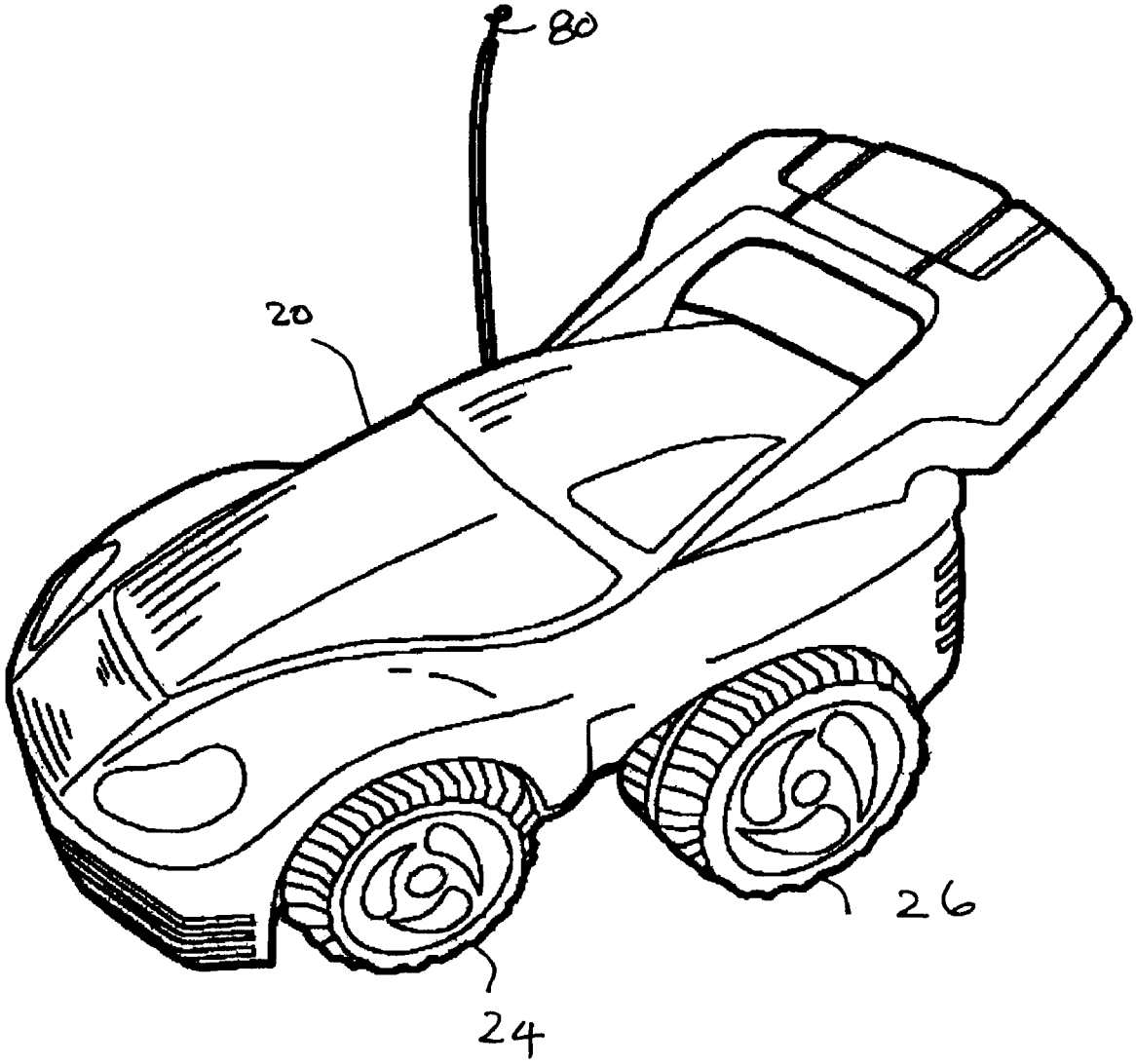
FIG. 1 is a perspective view showing a toy car in accordance with the invention.
Figure 2:
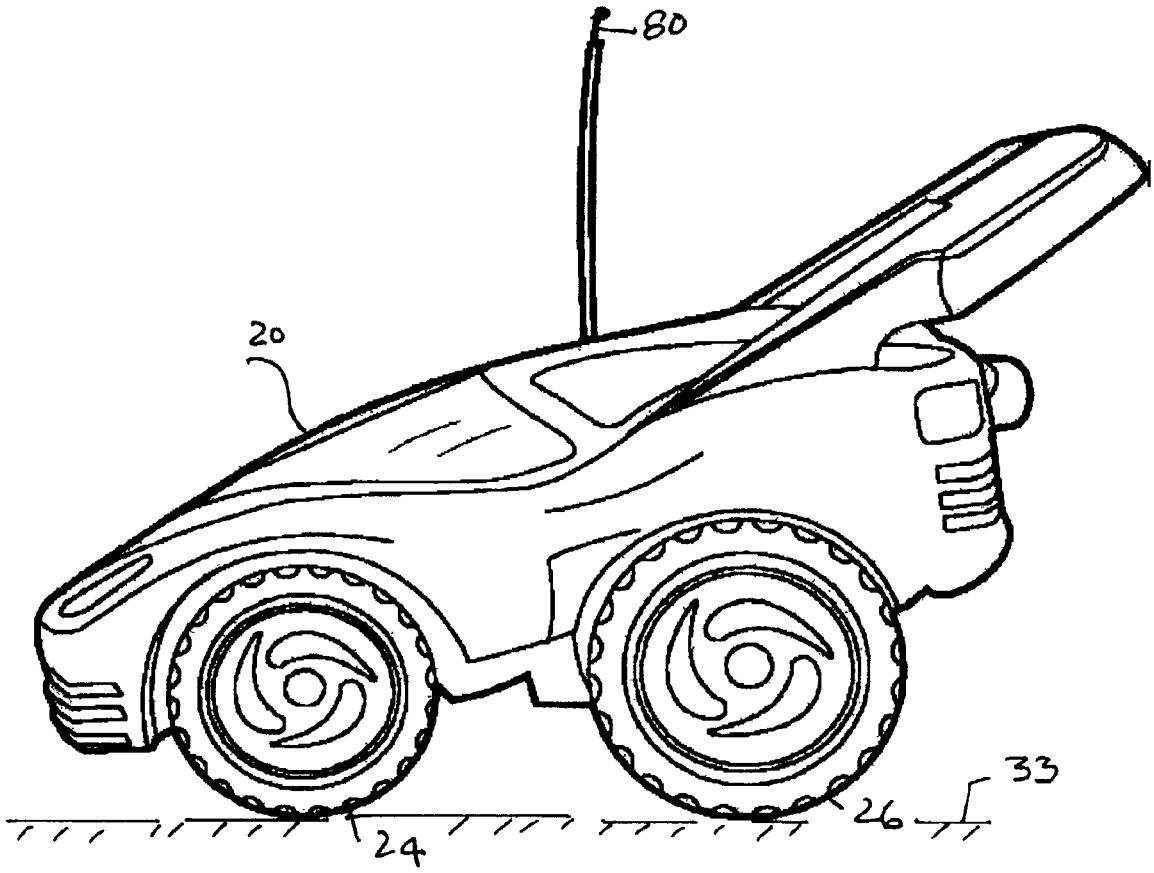
FIG. 2 is a side view of the car.
Figure 3:
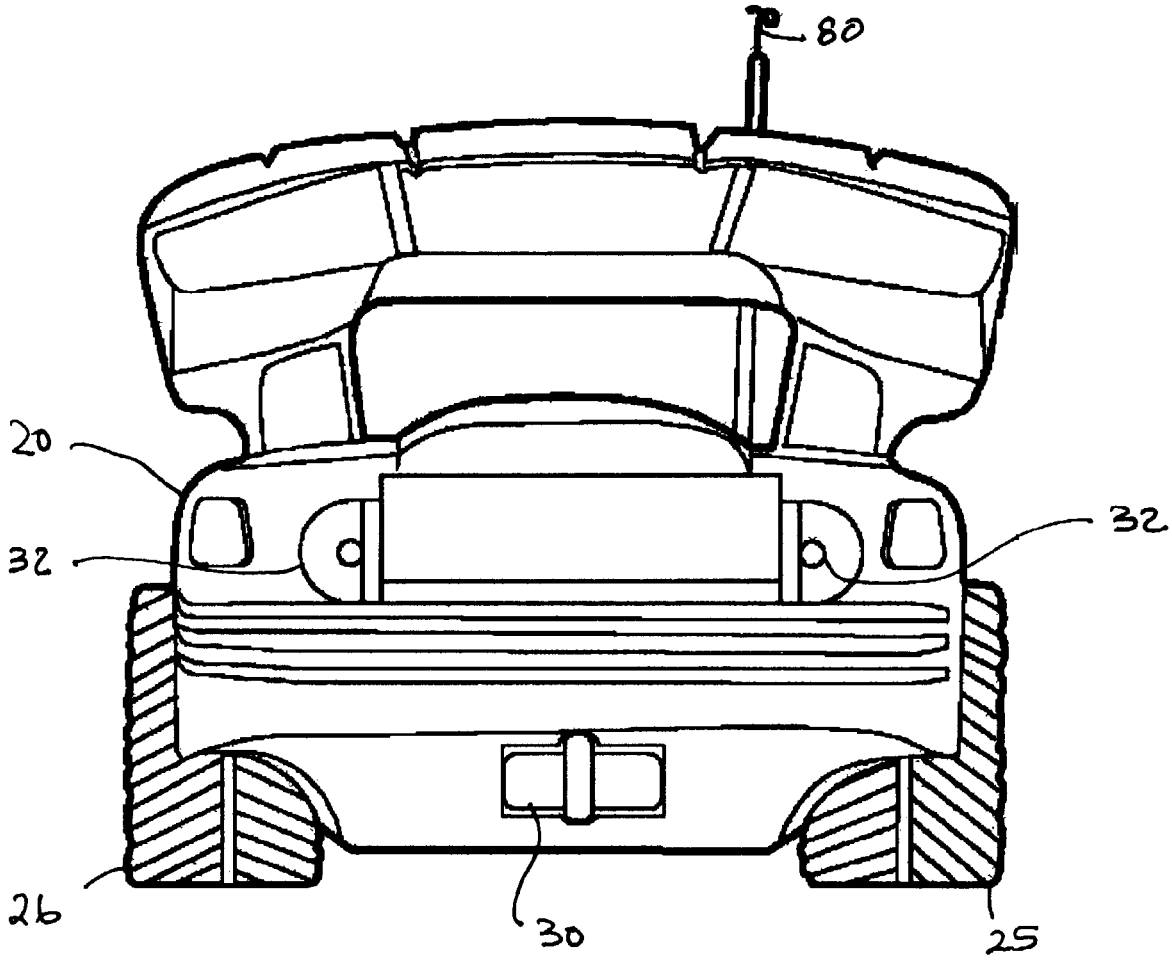
FIG. 3 is a rear view of the car.
Figure 4:
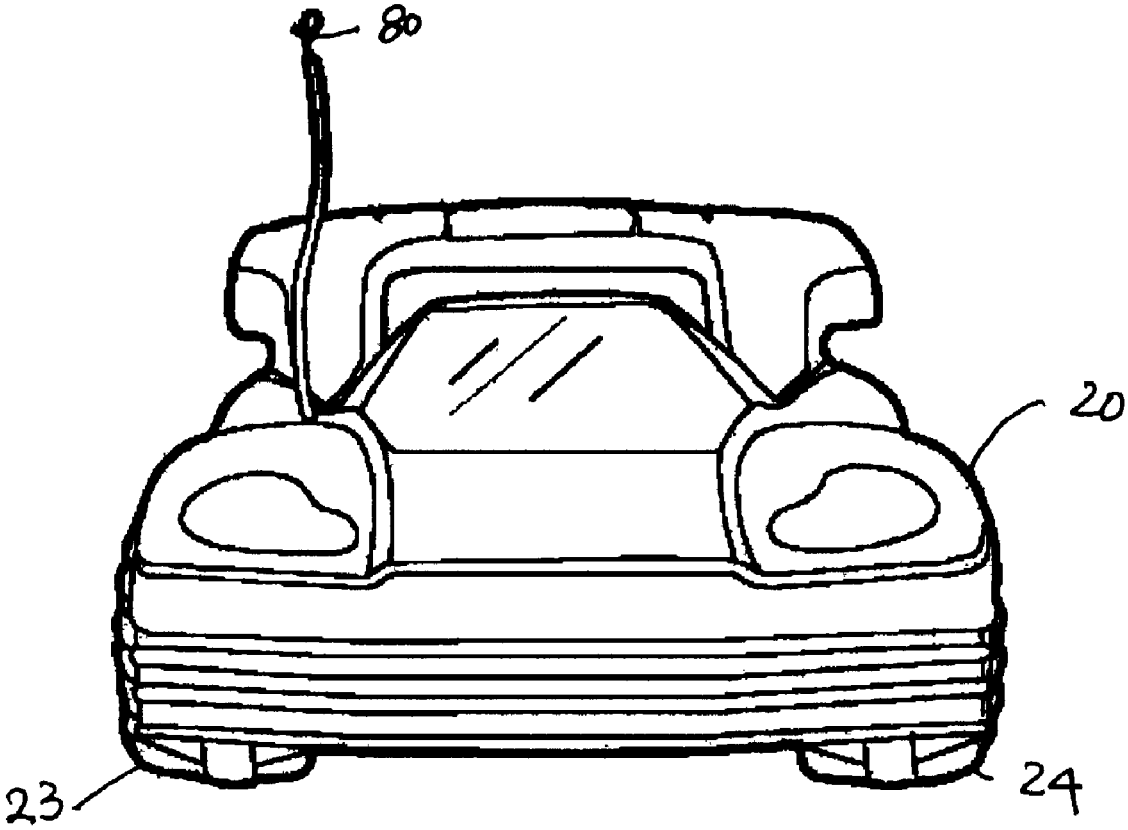
FIG. 4 is a front view of the car.
Figure 5:
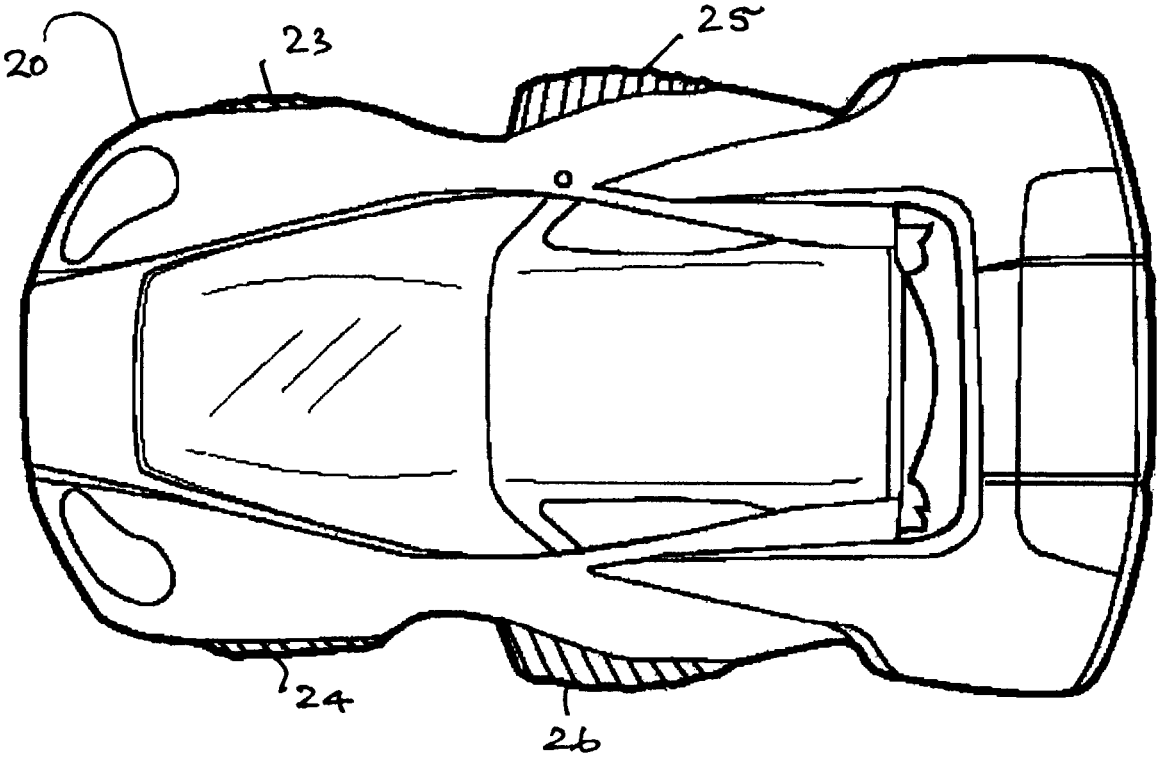
FIG. 5 is a top view of the car.
Figure 6:
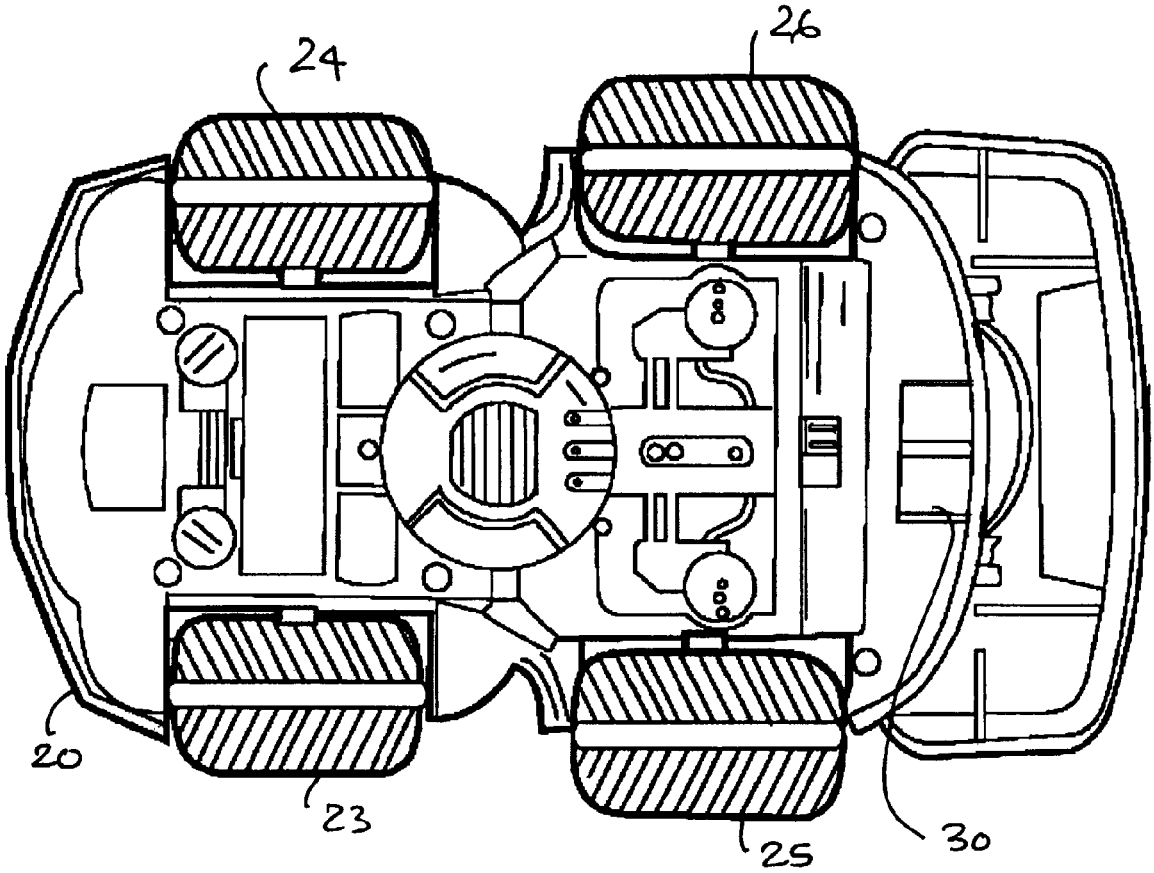
FIG. 6 is an underview of the car.
Figure 7:
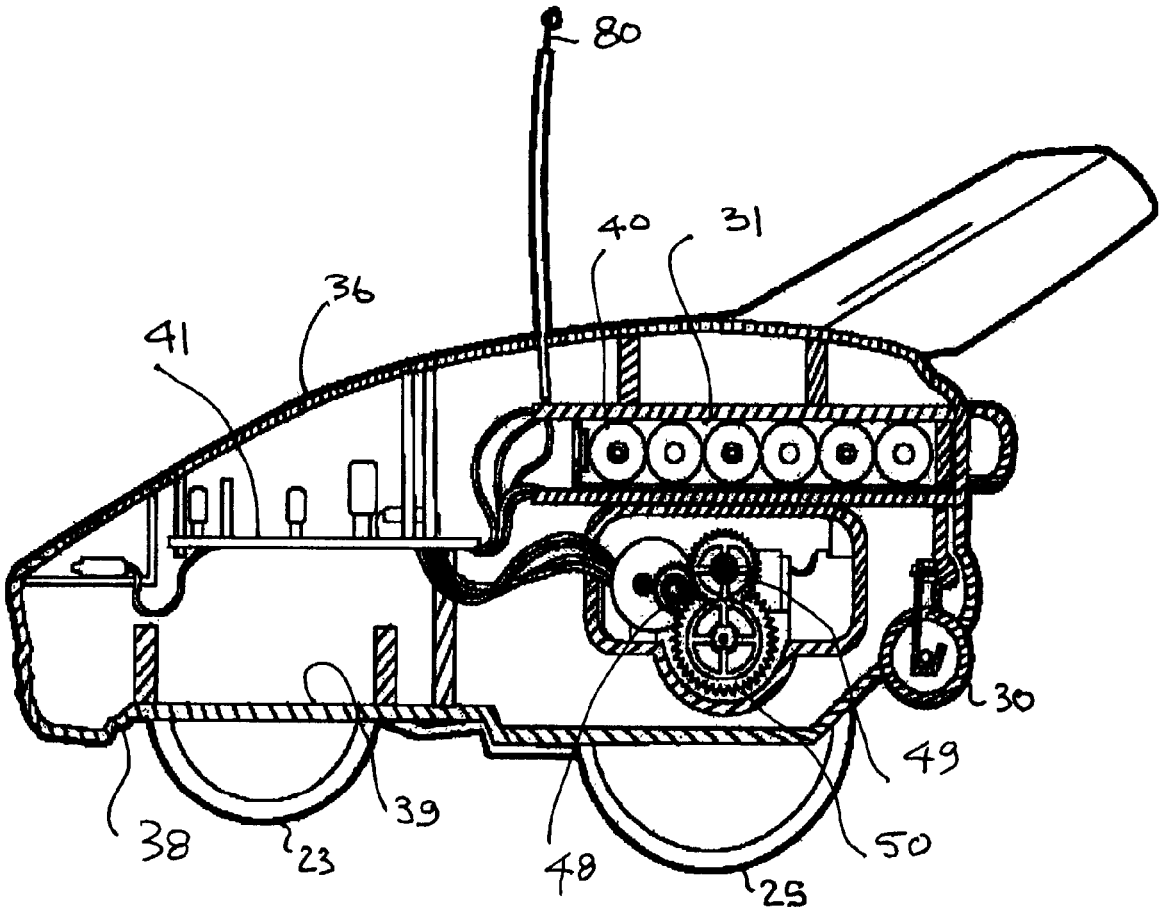
FIG. 7 is a sectional side view of the car showing the various mechanisms for driving the wheels and the electronic control system.
Figure 8:
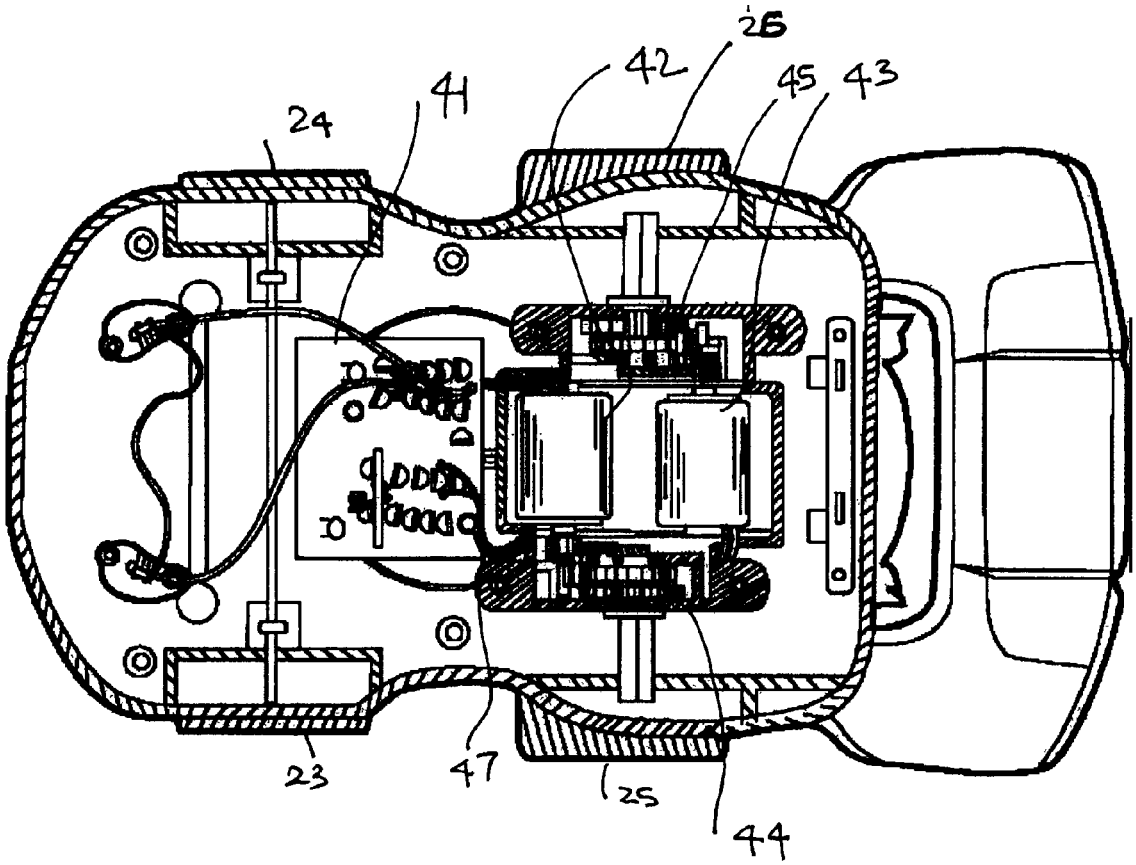
FIG. 8 is a sectional under view of the car showing the drive motors for driving the rear wheels of the vehicle.
Figure 9:
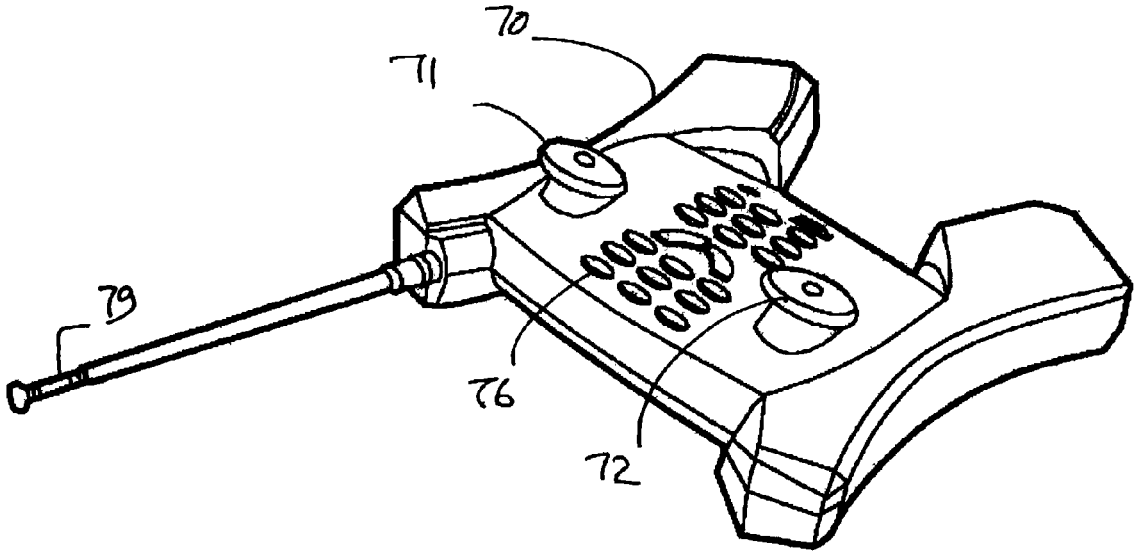
FIG. 9 is a perspective view of a handheld remote control unit showing a keyboard panel and two joy sticks.
Figure 10:
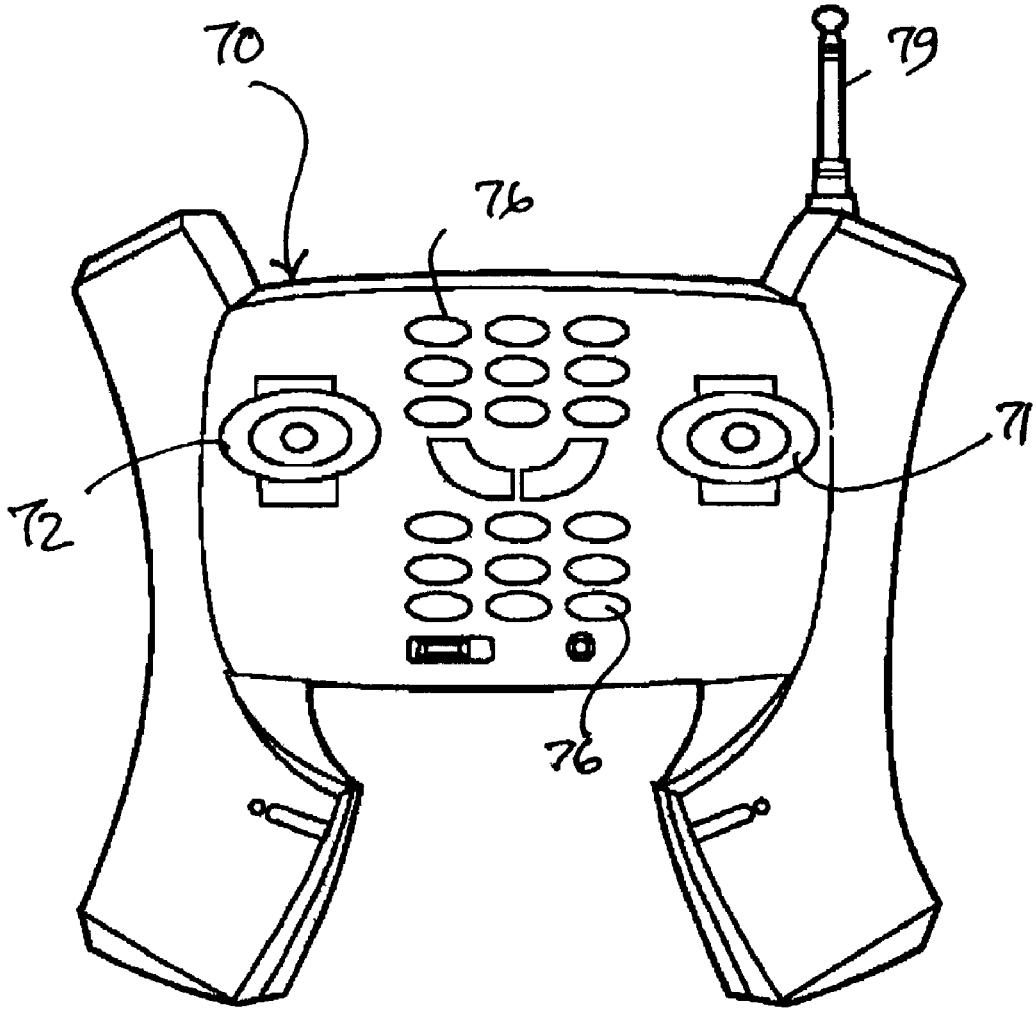
FIG. 10 is a top view of a handheld remote control unit.
Figure 11:
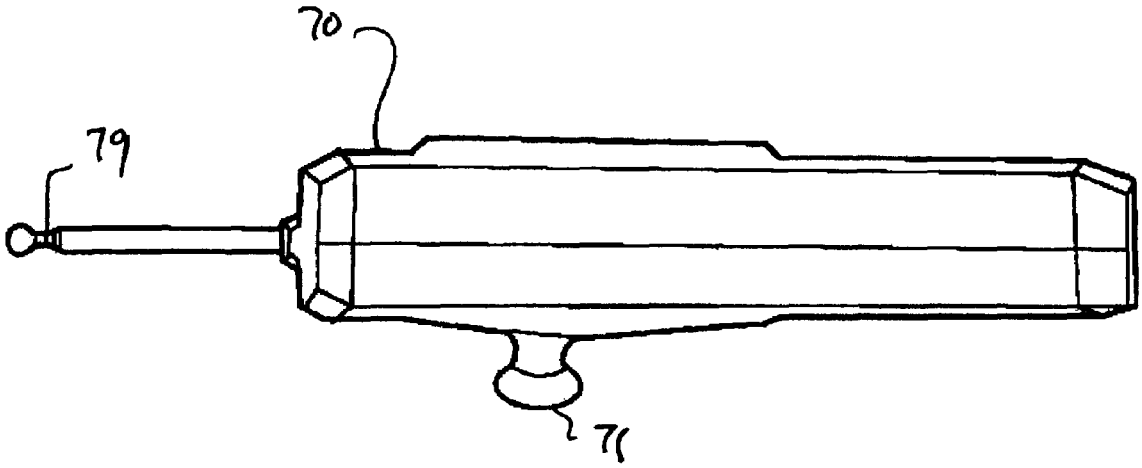
FIG. 11 is a side view of a handheld remote control unit.
Figure 12:
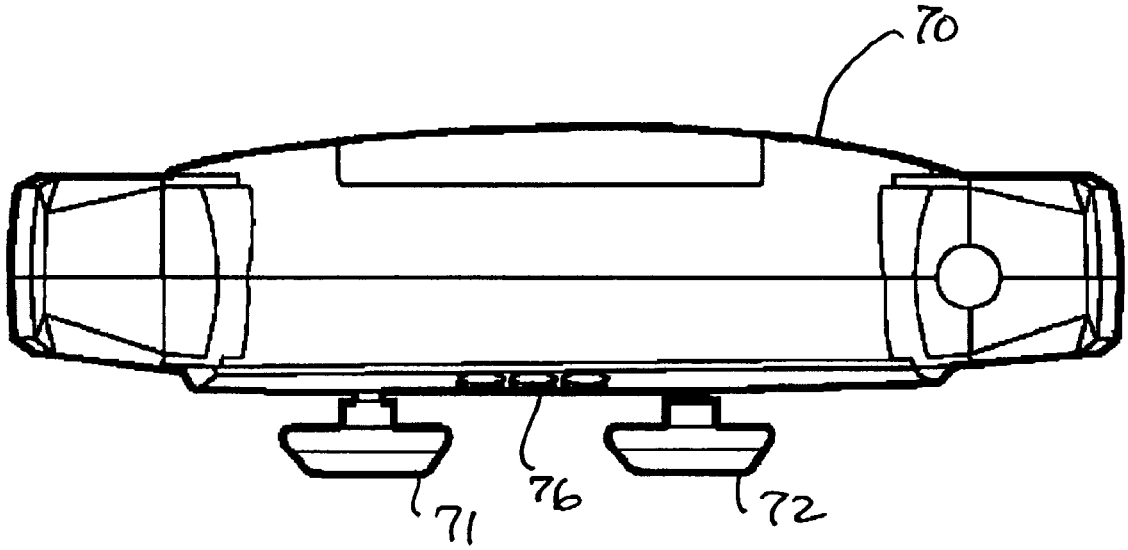
FIG. 12 is a front view of a handheld remote control unit.
Figure 13:
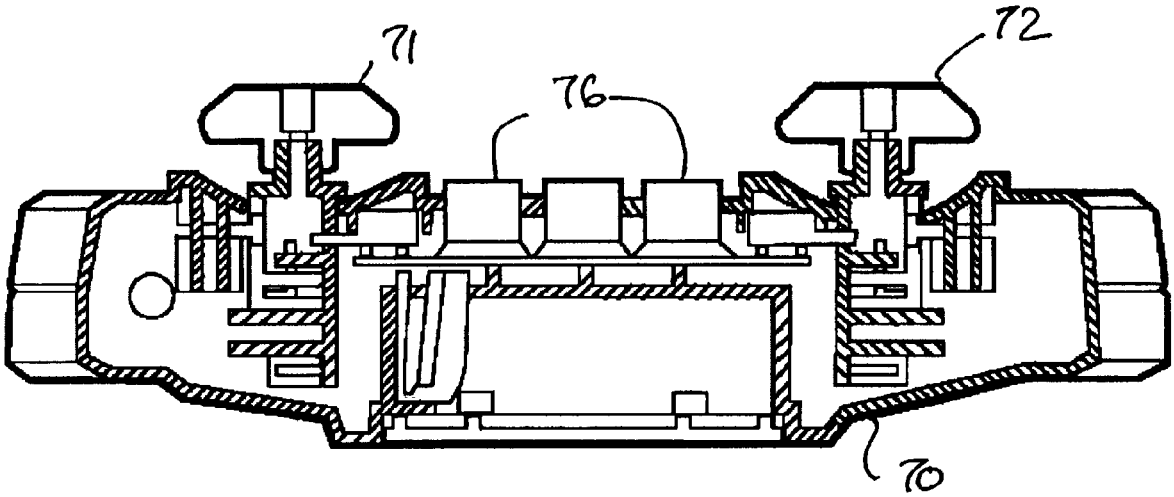
FIG. 13 is a sectional front view of a handheld remote control unit.
Figure 14:
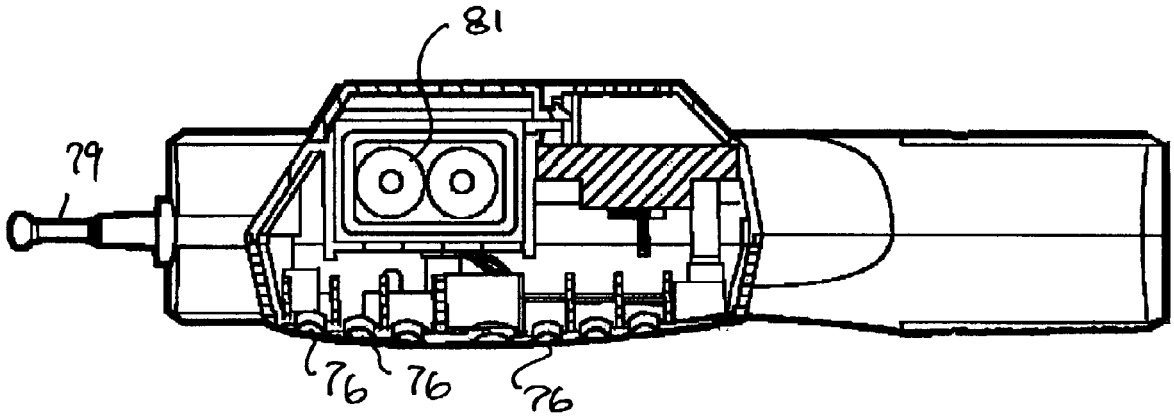
FIG. 14 is a sectional side view of a handheld remote control unit.
Figure 15:
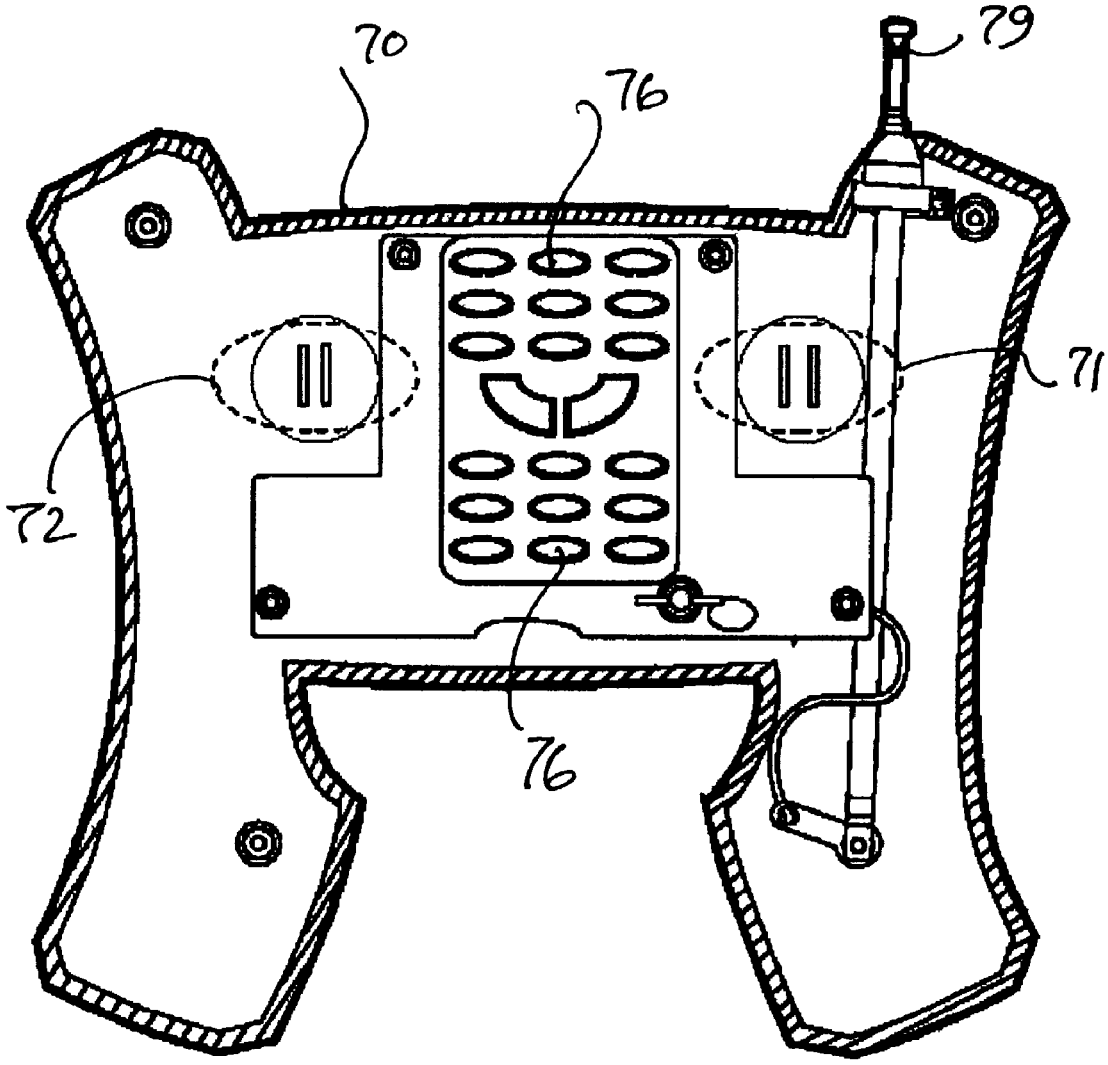
FIG. 15 is a sectional top view of a handheld remote control unit showing additionally the keyboard responsive board and the antenna.
Figure 16:
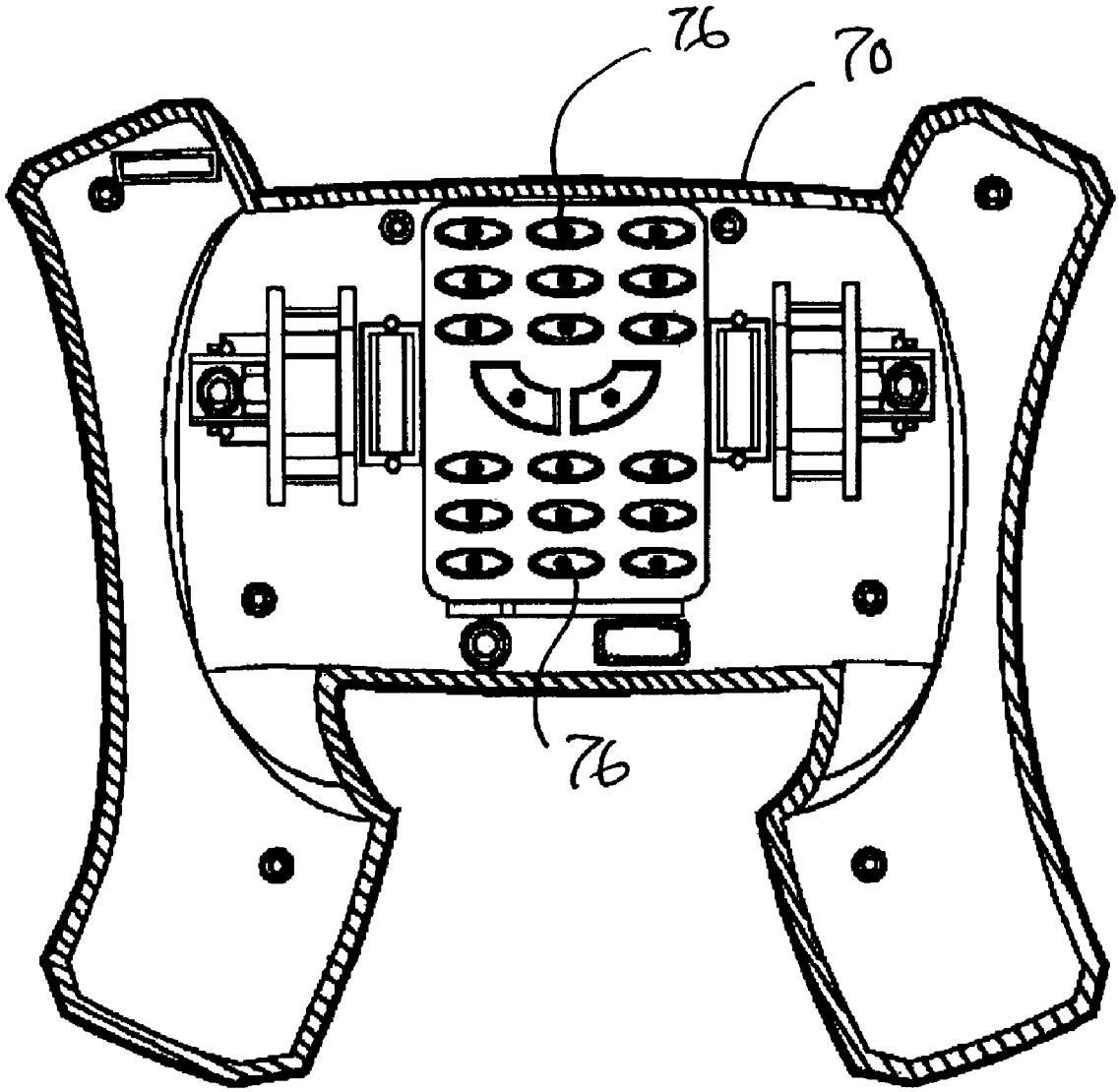
FIG. 16 is another sectional top view of a handheld remote control unit without the antenna and showing some of the joy stick or control stick components.
Figure 17A:
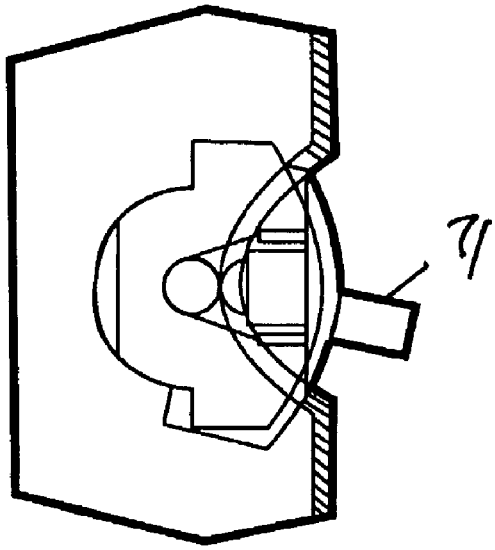
FIGS. 17-17*c* are different sectional views of a portion of a handheld remote control unit.
Figure 17B:
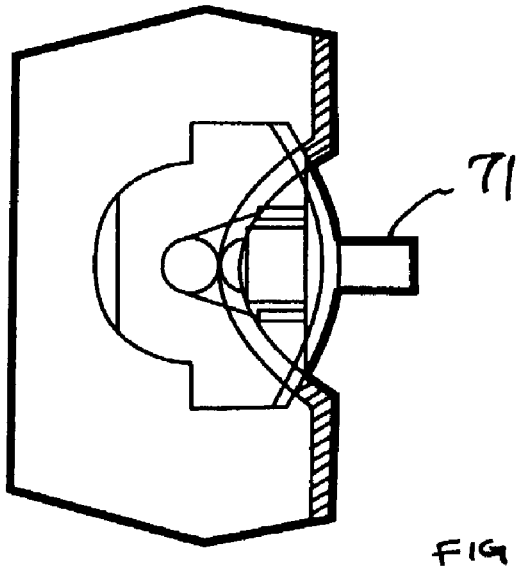
Figure 17C:
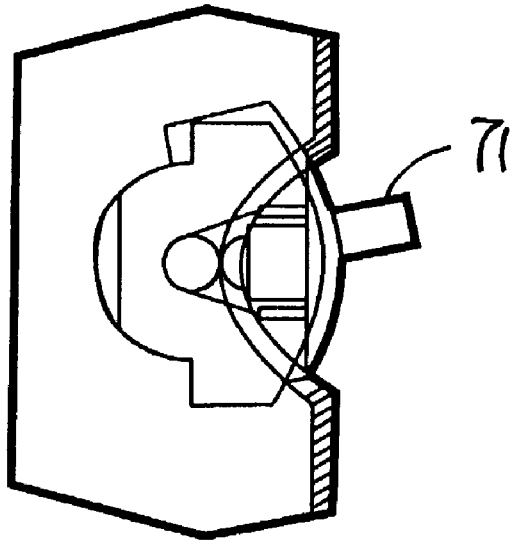

The invention is illustrated in relation to a car. The contents of U.S. Pat. Nos. 6,390,883 and 6,250,987, both in the name of the present applicant are incorporated by reference herein.

A vehicle 20 has four spaced wheels, namely, front wheels 23 and 24 in the front of the vehicle 20 and rear wheels 25 and 26 in the rear of the vehicle 20. Wheels 25 and 26 are driven respectively by motors in a manner that will be described more fully below.

At the rear of the vehicle, there is a transversely located rotatable roller 30, which is operational when the vehicle 20 tips into a pop wheel position. The center of gravity of the vehicle in this situation is established so that the rear wheel 25 and roller 30 can balance the vehicle in this position. The control system permits for the vehicle to tip when an appropriate signal is inserted into the keyboard.

When the vehicle tips, it balances on the surface 33 so that the wheel 25 and the roller 30 engage on that surface. The operation of the vehicle is such that it can move on the surface 33 in a forward, rearward, left turn, right turn, or side sinusoidal direction with smaller or larger curves as programmed into the vehicle 20.

The rear of the vehicle includes a battery compartment 31, which has a door, and into which several batteries can be located. The battery compartment 31 can be opened through one or more door switches or locks 32, which is appropriately turned to provide access or closure to the battery compartment 31.

The front wheels 23 and 24 are mounted on a suspension mechanism with a suitable helical springs. The shell of the body is shown as numeral 36, and can be cast as plastic having an upper portion 37, which can be screw connected with a lower portion 38. Within the molded plastic components, there are support elements which can form the structure of the internal workings of the car. This includes a floor 39 for the battery compartment 31.

At least one battery 40 is shown in the battery compartment 31. Mounted ahead of the battery compartment 31, there is a circuit board 41 which has in part the control circuit to drive two motors 42 and 43, respectively. Motor 42 is operational through a gear wheel mechanism 44 to operate the wheel 25, and motor 43 is operational through a gear wheel mechanism 45 to operate the wheel 26. Power from the control board 41 is directed through a series of conducting cables 47 to the motors, and in turn, the gear mechanisms. Gear mechanism 44 include at least three interlocking gears 48, 49, and 50, which activate the wheel 25. A similar gear system 45 is applicable for wheel 26.

There is a remote controller unit or system 70 with the toy 20. The remote controller 70 is radio controlled. The independent remote control unit or device 70 is used to instruct the toy 20 to perform individual or separate actions and to activate the preset program. The user can also interrupt or adjust the preset program by pushing forward or pulling backward the appropriate control sticks 71 and/or 72 on the control unit 70. A built-in receiver 73 on the toy 20 can translate, through decoder 74, the signal transmitted from the control device 70 and to cause the actions, sound and light effects according to the command.

In the receiver, there is a main control unit 74 connected with a motor control unit 75 for the respective left motor 43 and the right motor 42. There is an ON/OFF switch on the toy 20 for the motors.

Figure 19:
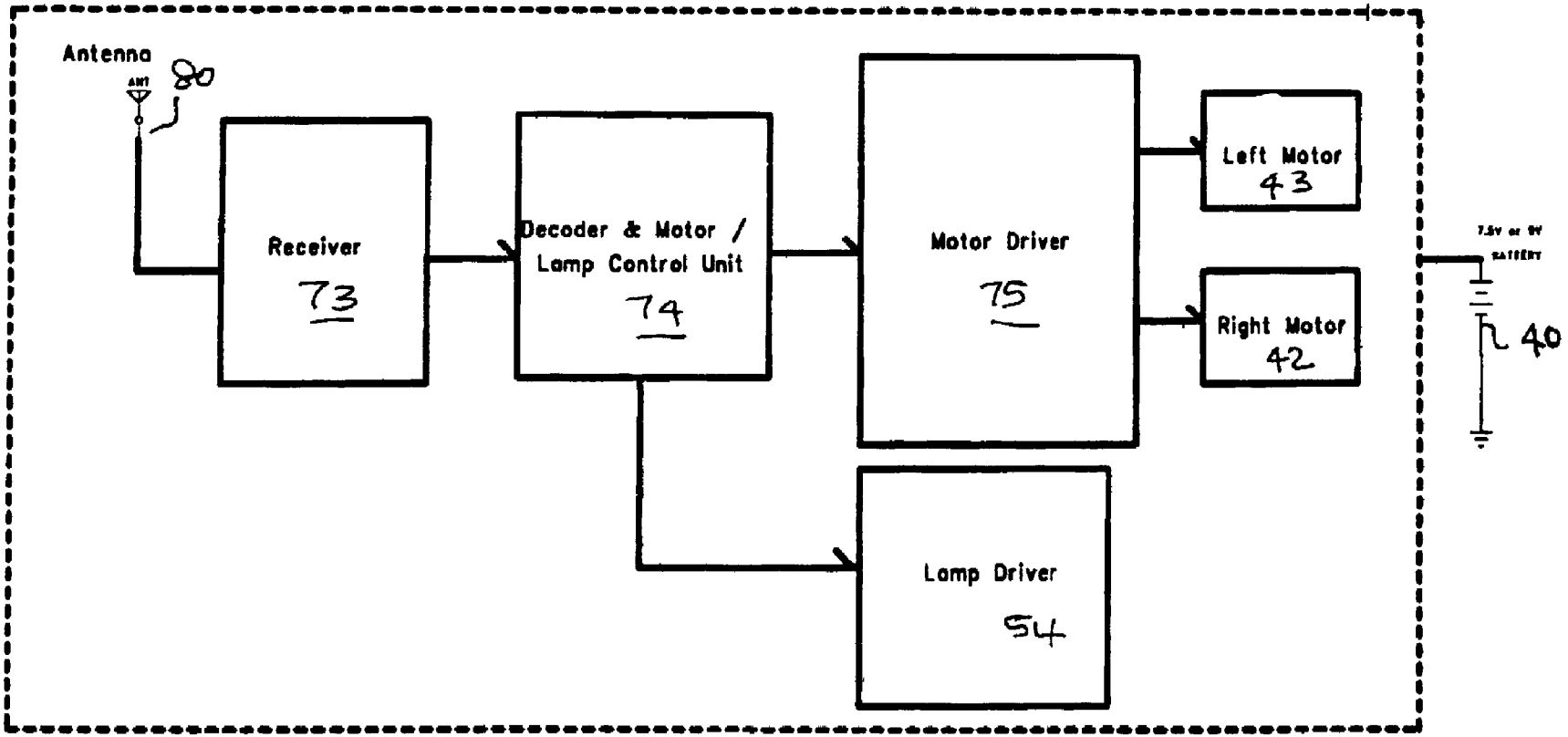
FIG. 19 is a block diagram illustrating the main components of the receiver of the toy.

On the remote control unit 70 there is a keyboard, which includes keypad buttons 76, with the multiple keyboard switches connected to the microprocessor programmable input control unit 51. The keyboard switches are press button elements which close circuits in the keyboard configuration and permit for a signal to be sent through the programmable input 51 to an encoder 52. Such signal after transmission and decoding ultimately controls the motors 42 and 43. The microprocessor input 51 also controls, through the encoder 52 and decoder 74, a light source device 54, which is operational remotely under given programmed conditions from the processor input 51. Light source device 54 may be, for example, an LED driver, or also a lamp driver as is illustrated in FIG. 19. In the remote control unit 70 there is a speaker 55 which is operational under the control of the microprocessor input 51 through encoder 52 and speaker driver 56. The motor driver 75 drives the two motors 42 and 43 and the light source device 54.

Figure 18:
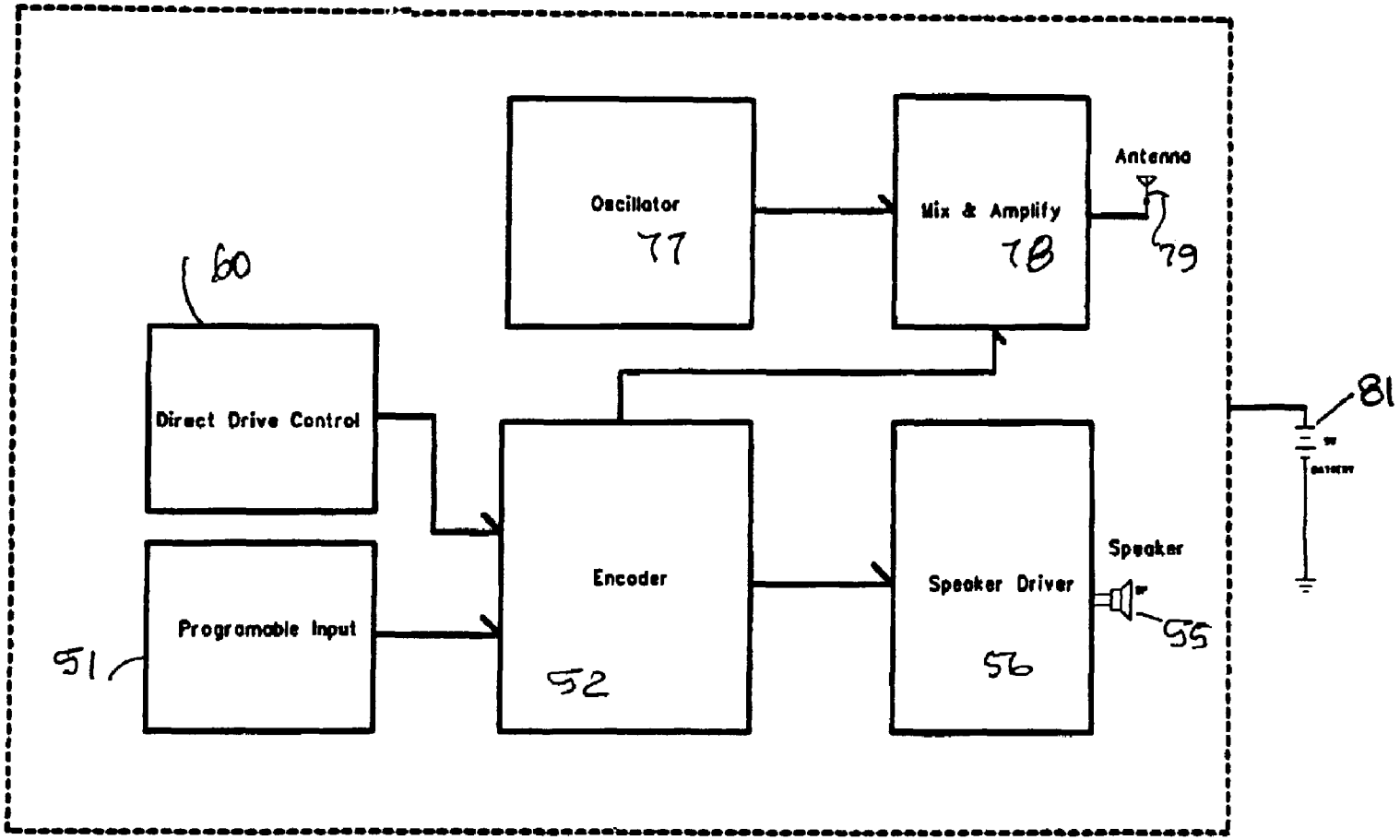
FIG. 18 is a block diagram illustrating the main components of the transmitter of the remote control unit.

The control circuit and microprocessors for the remote control unit 70 and the toy 20, respectively, are described in further detail with reference to FIGS. 18 and 19. Both units have suitable battery power.

The remote controller 70 provides for an interactive programming system for a movable toy 20. It allows the user to program through the remote control 70 the object performing a series of preset actions chosen by pressing appropriate keypad buttons 76 and on the remote control unit 70. Ideally, there are no programmable features on the car. All programming input is effected by the remote control unit 70. Those actions are preset in different keys 76 and accompanied by sound effects on the remote control 70 and light reactions on the toy 20. The programming system is driven by an encoder 52 on the remote control 70 which is responsive to the different keys 76.

The toy 20 is programmed through the remote control system 70. A programmable and radio frequency controllable toy 20 includes a movable toy 20 with programming keypad buttons 76 on the remote control unit 70. The toy 20 includes an integrated circuit chip 74 connected with receiver 73. Separately, the remote controller 70 has a built-in direct drive control unit 70 with control sticks 71 and 72, encoder 52, radio oscillator 77, frequency amplifier 78, and an antenna 79. There is a speaker system for sound effects on the remote controller 70 associated with the actions of the toy 20.

The player can drive the movable toy 20 freely in forward, backward, turn left or turn right freely by using different keys 76 of the remote control unit 70. Additionally or alternatively, the player with the remote control 70 can also run the programmed actions by pressing a "GO" key which is one of the keys 76 on the controller 70. If the program is not set, there is an error sound. To interrupt the program, press the "GO" key; press the "GO" key again to restart the entire program. Alternatively, the use of the wheel control buttons causes a pause in the running program. Release causes a continuation of the rest of program automatically.

Radio frequency transmitter 78, through antenna 79 sends out the signals to the toy 20. The control sticks 71 and 72 are for direct drive and a "GO" key runs the programmed actions as keyed in by different keys 76 on the keypad.

Operation of the control keys can be as follows:

Push Forward Control Stick 72=Turbo Left Wheel Forward

Push Backward Control Stick 72=Turbo Left Wheel Backward

Push Forward Control Stick 71=Turbo Right Wheel Forward

Push Backward Control Stick 71=Turbo Right Wheel

There are selected main keys 76 on the remote control unit 70 for programming 14 different stunt actions, 2 demos and "GO" functions into the vehicle 20. Each action is preset with specific distance, speed and timing. These are as follows: Stunt Actions; Forward; Backward; Turn left; Turn right; Turbo rotate; Pop Up Wheelie; Vibrate; Pause; Sine Curve Forward; Hopping; Sweep; Wavy Rotate; Swing; Quick U-Turn; Demo Action 1; Demo Action 2; Go.

The program is input by activating any combination of action keys on the remote control unit 70. Up to a series of 32 actions are storable. Pressing the "GO" key would cause the toy 20 to run.

The demo is operated by pressing the "Demo" key. These demos preferably cannot be programmed. The "Demo" key can activate the car simultaneously, without a need to press the "GO" key.

When the power of both the remote control unit 70 and the toy 20 are on, the movable toy 20 is in a standby mode to receive a signal from the control unit 70. Should the movable toy 20 be left unattended for 5 minutes, the toy will make a sound for every 5 minutes to remind the player with the remote control unit 70 to turn off the power or the sound will continue until the batteries exhausted. The program is stopped by pressing the "GO" key. The entire program is restarted again by pressing the "GO" key once more.

The movable toy 20 includes the following elements. There is a radio frequency receiver 73 for translating the received signals from radio frequency transmitter on the remote control unit 70. A one piece antenna 80 receives the signals; and an integrated chip decoder 74 stores the predetermined instructions for action and light effects, and to respond to the different programmed instructions for toy 20.

The two motors 42 and 43 react to the signals from the stored programs to activate the body to move in different selected direction in the form of wheels 25 and/or 26 or other devices. There are light bulbs for the headlights associated with the actions.

As illustrated in the drawings, the control sticks 71 and 72 of the remote control unit 70 can take many positions which can be rockable or movable about one axis. In some variations they may be movable about different axes, or mounting points as shown. In this case the sticks can be programming, playing and movement of the vehicle can be suitably effected. Suitable batteries 81 can be used in the remote control device. Different shapes and formats can be used for the remote control unit. Likewise different kinds of devices, toys or vehicles can be the subject of the device which is both programmable and separately remotely controllable.

Example Toy and Operational Characteristics

An exemplary toy automobile with the programmable features has the following characteristics: an infinite amount of programming possibilities, about $128^{16}$; programmability; 8 action keys; 4 distance or timer keys; and 3 function keys. The function keys are designated as Go; Demo; and Shift keys.

Sound Effects can include screeching, honking, speeding, acceleration, engine noise and other verbal sounds. These sounds can be related to the action of the car.

The programming is effected remotely and is communicated by radio or infrared control. The product includes one remote controller transmitter (TX) 70 and one receiver (Rx) in the toy 20. In the Rx, there is a standard 5-function remote control decoder IC in the market. The five functions are Forward, Backward, Turbo, Leftward and Rightward. In a standard application, there is the remote control encoder IC 52 in TX. It can be used with the decoder IC to provide a complete control functions to the remote-controlled toy.

The encoder 52 includes:

18 pre-defined stunt actions 48 programmable actions in one run and all programmable steps are kept in TX—all programmable steps are real time transmission. That is to say, continuous data will be sent to Rx until program finish—switch over between programming and TX control—realistic sound effect from TX direct drive and full function radio control by joystick—transmitter frequency can be used to 27 MHz, 40 MHz or 49 MHz There are 18 predetermined stunt actions. These are the following:

| | |
|---|---|
| 1 - Left Back | Backwards turn left |
| 2 - Left Front | Forwards turn left |
| 3 - Rotate Left | Self anti-clockwise rotation |
| 4 - Speed Up | Accelerate move straight forward |
| 5 - Forwards | Move straight forward |
| 6 - Backwards | Move straight backward |
| 7 - Rotate Right | Self clockwise rotation |
| 8 - Right Front | Forwards turn right |
| 9 - Right Back | Backwards turn right |
| 10 - Backwards turn | Fast move back and pop up, then turn back and go |
| 11 - Zig Zag line | Pop up and move forward with Zig Zag path |
| 12 - Swing | Turn the head left & right alternately |
| 13 - Wavy rotate | Self rotate with Pop up and get down position |
| 14 - Pause | Keep still for a moment |
| 15 - Vibrate | Shake the car body by it's own |
| 16 - Spring path backward | Move backward with spring path |
| 17 - Pop up & down | Head raise up and get down |
| 18 - Pop up & hold | Head raise up and hold |

All the actions are with sound effects. There is no special encoding scheme in the encoder. Besides direct drive coding, the main special function is that it consists of 18 predefined actions coding that allow user to control the receiver.

There are the 18 predefined actions above and additionally 3 demo actions. 48 programmable actions in one run are possible. The transmitter stores up to 48 programmable actions. The user presses the "GO" key one time in order to make the receiver perform all the stored programmable actions. This programming action is achieved as follows.

Step 1 Press one of the 18 predefined action key or 3 of the demo key to input actions (Press action key once to input one unit of action)

Step 2 Repeat Step 1 to continue input program

Step 3 Press GO key to start the program

Note 1: Total programming input could be up to 48 steps in one run including demos.

Note 2: Direct Drive Key has the priority in input which can also overdrive/interrupt The current Program Actions.

Note 3: All Program Key should be activated after the Command GO key is being pressed. But one exception is when user just finish the Direct Drive key within approx. 0.3-1 sec time, Program Action Key can activate action instantly without pressing the "GO" key.

The advantage of keeping all programming steps in the TX is that it is easy for user to control the RX and perform predefined action by means of the transmitter only. It is not necessary for a user to pick up the RX and input predefined action.

In TX, the encoding signal will be generated by a MCU. This signal is mixed and amplified with a carrier frequency. After that, this modulating signal is transmitted through antenna network. In RX, the modulating signal is picked up by a decoder MCU. Then the control signal drives the motor and lamp.

The invention provides for a direct drive radio control system. There is a simple control that only able to send signal to RX and perform Forward, Backward, Leftward and Rightward function.

The advantages of having multiple transmitting frequencies (27 MHz, 40, 49) is that several RX units with different frequencies can be played at the same time. Thus it is not necessary to have specific commands transmitted on specific frequencies.

All programmable steps are real time transmission. The action of the RX responds to the TX signal immediately. Programmable steps are composed with a certain predefined movement actions. When a user presses the "GO" key, TX starts to transmit a series of corresponding movement signal to RX according to the programmable step has been selected. In this case, the RX carries out the movement one by one and eventually complete the required program action.

Programmable Through Remote Controller

The dual motor programmable remote control unit 70 is preset with 3 demo functions, there are also 9 action keys, 9 other action keys and shift keys for programming which store up 32 controlling features and 16 interactive process memory positions. The programmable car reproduces sound effects in following the movements. There is an LED light which acts and reacts and matches the programming action for the car.

There are ON/OFF switches on the controller and the car and when both are turned to be in the "ON" position, the car honks twice telling the user that it is ready. The demo button or program button is then used. Pressing the Demo Key once, twice or three times activates 3 different demonstration operations of the automobile.

Many other forms of the invention exist each differing from others in matters of detail only.

Different levels of programming are the following.

Beginning Programming:

Press one Action Key and one Timer Key. Press "GO". Repeat the above basic function and add a second Action Key and a second Timer Key, before pressing "GO". The car holds up to sixteen different actions & timers on each run.

Intermediate Programming:

Adding the Shift Key (before the Action Key or the Timer Key) to the basic programming alters the original actions. Press the Shift Key and one Action Key at the same time. Then press a Timer key. Press "GO". This program alters the action making it different than the basic program. Press one Action Key. Then press the Shift Key and one Timer Key at the same time. Press "GO". This program alters the timing making it different than the basic program.

Advanced Programming:

Adding the Shift Key (before the Action Key and the Timer Key) to the basic programming alters the original actions. Press the Shift Key and one Action Key at the same time. Then press the Shift Key and one Timer Key at the same time. Press "GO". This program alters the action and timing making it different to the basic and intermediate program.

To interrupt the program while the car is in action, press the "GO" Key and the car stops. To repeat the last programmed action, press the "GO" Key and the car repeats the last programming. Should the user input the wrong program and want to start over, press the Shift Key down for 3 seconds. The car beeps telling the user that the memory has been erased.

There is an automatic shut off after 30 minutes if the car is left in the "ON" position. Within these 30 minutes, a reminding horn sounds every five minutes inviting new play and programming.

If desired, function keys can be provided for multiple combination of keys.

Operation Description

When the power is on, and the battery is charged, the system goes to a standby stage, and a sound signal is made, such a honking: 'Beep . . . Beep . . . Beep". In the normal stand-by stage, the car performs a sound signal every 5 minutes (maximum 5 times) if no command is input or when the program has been completed. Programming is effected by a keying in procedure. The Action+Timer is one action process. There is a step by step keying in process, with a maximum of 16 interactive processes.

Example sequences of nine different keying sequences are now described. Whatever command keys are pressed on the remote control unit, there is no right or wrong keying, and the car functions according to the last right keyed-in procedure.

At any time during the car's movements based on correctly keyed-in procedures into the remote control unit, the car stops canceling all programmed actions should the "GO" key be pressed on the remote control unit.

Although the invention has been described with reference to a four-wheeled automobile vehicle it is clear that the invention also has application to other devices such as different toys or novelty items. The kind of toys could be a ship, plane, different kind of automobile such as a three-wheeler, or a motor bike. The surrounding environment would be appropriately a surface, or could be the water in the case of a ship, or air in the case of a plane. In the case of a ship, boat, or plane, the motive generator can be a propeller or screw device.

Sensors for determining the environment could be to determine when the body approaches an obstacle and needs to veer in one direction or the other or stop. Changes in temperature or light could also be other things that the sensors could respond to and then cause the programmable microprocessor to vary the action which is preprogrammed into the device.

The invention is to be determined solely by the following claims.

I claim:

1. A programmable toy device comprising:

a) a body;

b) a motor for activating a motive generator on the body for causing the body to move relative to a surrounding environment, and including a receiver for electronic signals;

c) a remote controller;

d) a key pad mounted on the remote controller including a series of control elements for operation by a user;

e) the key pad and control elements in the remote controller being connected with a microprocessor, located in the remote controller, for encoding control signals, and being connected with a transmitter being for transmission of the control signals to the receiver in the body, wherein the microprocessor is programmable, by a program having a plurality of program actions, so as to permit for a selection of motions;

f) the receiver in the body being connected with a decoder for translating signals received into control signals for operating the motive generator whereby the body is caused to move in different directions according to the action of the motive generator;

g) the arrangement being such that the key pad on the remote controller is operable or controllable to effect programmable control of the motive generator in the body, and wherein the keys of the key pad are preprogrammed such that keys represent different motion events to be encoded and transmitted to the receiver; and h) wherein the remote controller is operable for direct drive control with priority of input over one or more of the plurality of program actions currently being executed by the microprocessor, and wherein the microprocessor continues execution of the plurality of program actions after the user stops the direct drive control.

2. A device as claimed in claim 1 wherein the motive generator is at least one wheel and the body is representative of a vehicle.

3. A device as claimed in claim 1 wherein there are two motive generators, the generators being a pair of wheels, each wheel being operated by a respective motor.

4. A device as claimed in claim 1 wherein the body is representative of an automobile vehicle and wherein there are four spaced wheels, and wherein two wheels are driven, the two wheels being motive generators.

5. A device as claimed in claim 4 wherein the driven wheels are the rear wheels of the automobile vehicle.

6. A device as claimed in claim 1 wherein the selection of motions includes multiple motions of forward, backward, left turn, right turn or sinusoidal.

7. A device as claimed in claim 6 including a motion of pop-wheeling, and wherein the center of gravity of the vehicle is located strategically relative to the wheels thereby to permit tipping of the vehicle according to the control of the wheel motion and thereby to permit pop-wheeling.

8. A device as claimed in claim 7 including a free roller element located towards the rear of the vehicle, the free roller element being for facilitating motion of the vehicle where the motion is in a tilted pop-wheeled state.

9. A device as claimed in claim 1 including a sound generator and a speaker for transmitting sounds in the remote controller, and means for selectively interacting the sounds to correspond with action of the motive generator on the body.

10. A device as claimed in claim 1 including a light generator for creating light on the body, and means for selectively interacting the light generator in relation to the activation of the motive generator.

11. A device as claimed in claim 1 wherein there are different transmission and receiver frequencies for operable communication between the transmitter and receiver, the transmission frequency being selected for a pre selected receiver, whereby multiple receivers, each at a discrete frequency, are controllable by the transmitter.

12. A device as claimed in claim 1 wherein, in the remote controller, the microprocessor is connected to the transmitter and in turn to an antenna, and wherein, in the body, an antenna on the body is operable to receive a transmitted signal, and wherein the decoder in the body is operable to decode the received signal to operate the motive generator.

13. A device as claimed in claim 1 wherein the key pad permits the operation of multiple controls which is thereby to permit the selection of multiple combinations of motion of the body.

14. A device as claimed in claim 1 including sensors for determining the nature of the environment surrounding the device, and means for relating the nature of the environment as sensed selectively to activate a sound, light, or motion according to signals from the sensor.

15. A device as claimed in claim 1 including a radio frequency transmitter in the controller and a receiver in the body, the transmitter and receiver permitting the device to respond to signals transmitted from the controller to the body.

16. A device as claimed in claim 1 wherein:

the keys of the key pad comprise a plurality of action keys each corresponding to a predefined stunt action; and the remote controller is operable to be programmed for a plurality of predefined stunt actions by a single activation of one of the plurality of action keys for each of the plurality of predefined stunt actions.

17. A device as claimed in claim 16 wherein the single activation is a single press of a button by a user.

18. A device as claimed in claim 16 wherein each of the plurality of predefined stunt actions comprises a preset distance, speed and timing.

19. A device as claimed in claim 1 wherein the control signals are transmitted in real time from the remote controller to the receiver.

20. A device as claimed in claim 1 wherein at least a portion of the plurality of program actions are each composed of a series of predefined movement actions.

21. A device as claimed in claim 20 wherein the predefined movement actions include one or more of the following actions: left, right, forward, and backward.

22. A device as claimed in claim 1 wherein the priority of input comprises the ability of the direct drive control to adjust the program being executed by the microprocessor.

23. A programmable toy vehicle comprising:

a body;

a motor for activating wheels on the body for causing the body to move on a surface;

a remote control unit;

a key pad located with the remote control unit including a series of keys for operation by a user;

the keys being connected with an encoding microprocessor located in the remote control unit for translating activation of a key to an encoded signal transmission to a receiver in the body for operating the motor whereby the body is caused to move in different directions on the surface according to the action of the motor on the wheels;

the arrangement being such that the motor, wheels, and a receiver decoding microprocessor are contained with the body, and wherein the keys are operable or controllable under the action of the keypad on the remote control unit, and the body being representative of an automobile vehicle with spaced wheels, and wherein at least one wheel is driven by the motor, the encoding microprocessor in the remote control unit being programmable, by a program having a plurality of program actions, so as to permit for a selection of motions;

the decoding microprocessor in the body being connected to control means for driving the motor;

the key pad permitting the operation of the multiple keys thereby to permit the selection of motion of the body;

wherein the microprocessor in the body is not separately programmable other than through the remote control unit; and wherein the remote control unit is operable for direct drive control with priority of input over one or more of the plurality of program actions currently being executed by the encoding microprocessor, and wherein the encoding microprocessor continues execution of the plurality of program actions after the user stops the direct drive control.

24. A toy as claimed in claim 23 wherein the body is representative of an automobile vehicle and wherein there are four spaced wheels, and wherein two wheels are driven by a respective motor.

25. A toy as claimed in claim 24 wherein the selection of motions includes at least one or multiple motions of forward, backward, left turn, right turn or sinusoidal.

26. A toy as claimed in claim 25 including a motion of pop-wheeling, and wherein the center of gravity of the vehicle is located strategically relative to the wheels thereby to permit tipping of the vehicle according to the control of the wheel motion and thereby to permit pop-wheeling.

27. A toy as claimed in claim 24 including a speaker for creating sounds, and means for selectively interacting via activation of the wheels with sounds from the speaker.

28. A toy as claimed in claim 24 including a light generator for creating light, and means for selectively interacting the light of the light source in relation to the activation of the wheels.

29. A toy as claimed in claim 24 wherein the decoding microprocessor in the body is connected to control means for operating the motor, and the control means operates a light source in the body.

30. A toy as claimed in claim 24 wherein the key pad permits the operation of multiple controls which is thereby to permit the selection of multiple combinations of motion of the body.

31. A toy as claimed in claim 23 including a radio frequency transmitter in the controller and a receiver in the body, the transmitter and receiver permitting the vehicle to respond to signals transmitted from the controller to the vehicle.

32. A programmable toy car comprising:

a body and four spaced wheels;

two motor means for activating a respective one of two wheels on the body for causing the body to move on a surface;

a remote detached controller;

a key pad located on the remote controller including a series of multiple control switches for operation by a user;

the key pad permitting operation of the multiple controls thereby to permit the selection of multiple combinations of motion of the body;

the control switches being connected with an encoding microprocessor located in the remote controller for translating signals received into control signals for operating, through a transmitter with the remote controller, and sending signals to a receiver in the body;

a decoding microprocessor with the receiver receiving the signals and being connected to control means for operating the two motors, and control means in the body for operating a light source in the body;

the receiver in the body acting with the respective motors whereby the body is caused to move in different directions on the surface according to the action of each motor on the respective one of the two wheels;

the arrangement being such that the key pad, switches and encoding microprocessor are contained in the separate remote controller, and wherein the microprocessor in the receiver is solely operable or controllable under the action of the remote controller, and the encoding microprocessor being programmable, by a program having a plurality of program actions, so as to permit for a selection of motions including at least one of multiple motions of forward, backward, left turn, right turn or sinusoidal; and wherein the remote controller is operable for direct drive control with priority of input over one or more of the plurality of program actions currently being executed by the encoding microprocessor, and wherein the encoding microprocessor continues execution of the plurality of program actions after the user stops the direct drive control.

33. A toy as claimed in claim 32 including a motion of pop-wheeling, and wherein the center of gravity of the vehicle is located strategically relative to the wheels thereby to permit tipping of the vehicle according to the control of the wheel motion and thereby to permit pop-wheeling.

34. A toy car as claimed in claim 32 including a radio frequency transmitter in the controller and a receiver in the body, the transmitter and receiver permitting the body to respond to signals transmitted from the controller to the body.

35. A toy comprising:

a) a body comprising a motor, for causing motion of the body, and a receiver, wherein the receiver comprises a decoder for receiving control signals to operate the motor; and b) a remote controller comprising a transmitter and microprocessor, for encoding the control signals, wherein:

the microprocessor is coupled to the transmitter for transmission of the control signals to the receiver;

the microprocessor is programmable, by a program having a plurality of program actions, to provide for a plurality of programmed motions;

the remote controller is operable for direct drive control by a user with priority of input over program actions currently being executed by the microprocessor, wherein the microprocessor continues execution of the program actions after the user stops the direct drive control; and the control signals are transmitted in real time from the remote controller to the receiver.

* * * * *